United States Patent [19]

York

[11] Patent Number: 4,852,942

[45] Date of Patent: Aug. 1, 1989

[54] CHILD'S DINNER SEAT AND METHOD OF FEEDING

[75] Inventor: Robert L. York, Lubbock, Tex.

[73] Assignee: Yet, Inc., Lubbock, Tex.

[21] Appl. No.: 241,320

[22] Filed: Sep. 7, 1988

[51] Int. Cl.[4] ..... A63G 9/10

[52] U.S. Cl. ..... 297/195; 297/174; 297/181

[58] Field of Search ..... 280/1.1 A, 289 WC, 47.13 R, 280/47.17, 47.25; 297/5, 6, 4, 140, 181, 195, 174, 134

[56] References Cited

U.S. PATENT DOCUMENTS 2,224,246 12/1940 Ames ..... 297/6
2,613,723 10/1952 Bryant ..... 297/181
4,695,072 9/1987 Brooks ..... 280/47.25 X

FOREIGN PATENT DOCUMENTS 2367455 6/1978 France ..... 297/134

*Primary Examiner*—James T. McCall
*Attorney, Agent, or Firm*—Wendell Coffee

[57] ABSTRACT

A child size replica of a western saddle is mounted upon a stand to form a seat. Rollers on the rear of the stand permit the seat to be rolled when the front is lifted. Rubber crutch tips on the front of the stand anchor the seat when it is placed at a dining table with the horn of the saddle under the edge of the table. Experience shows that children sit quietly and peacefully in the saddle at the dining table.

4 Claims, 1 Drawing Sheet

CHILD'S DINNER SEAT AND METHOD OF FEEDING

BACKGROUND OF THE INVENTION (1) Field of the Invention

This invention relates to dining, and more particularly to dining with children in restaurants. A restaurant manager is one having ordinary skill in this art.

(2) Description of the Related Art

A problem exists with children dining at a table with adults, and particularly for children dining in restaurants. It is desirable to provide a child with a suitable seat that the child will sit in without complaining by crying or fussing.

Traditionally, this problem has been solved by providing the child with a highchair which is a self-contained eating place. Highchairs have a raised seat with a folding tray that is slightly higher than the table top. The child can be placed in the highchair, the tray folded down, and the child pulled near the dining table. The tray is above table top height so that the child's tray overlaps the top of the dining table. In other instances, the tray can be left folded away from in front of the child and the child's food placed upon the dining table in front of him.

Another solution is to provide a small seat which rests in an adult chair. The child can sit in the small seat in the adult chair at a comfortable height in front of the table with the food on the table in front of him.

Restaurant managers are accustomed to having children rebel at such arrangements, fussing and crying, and either standing in adult chairs or sitting in the laps of adults or moving around the restaurant. All such conduct is disruptive to the otherwise pleasant surroundings of the restaurant.

At playgrounds and amusement parks, children readily and eagerly will sit in certain rides. I.e., on carousels children are eager to sit on saddles. They are also eager to sit on replicas of animals, automobiles, motorcycles and the like.

In this application, the word "replica" is restricted to meaning a replica of childhood fantasy such as a saddle, boat, automobile, motorcycle, swan, alligator, longhorn steer, horse, or other animal.

SUMMARY OF THE INVENTION (1) Progressive Contribution to the Art

I have invented a child's seat for eating at a dining table. A replica is placed upon a stand so that the child's seat is at a height so that the replica may be placed at the table and the child is at proper height to eat from food placed upon the table. The stand upon which the replica is mounted has two wheels at the rear so that if the front of the stand is lifted above the floor, the stand can readily be rolled to the table. The front of the stand has legs which have rubber tips or the like so that when it is at the table, the stand is anchored at the table; and therefore, rocking motion of the child will not cause the replica to move around. The forward portion of the replica is lower than the table top so that the forward portion of the replica moves under the table when it is in the position for eating so that the child is close to the table, as is desirable for feeding a child.

(2) Objects of this Invention

An object of this invention is to seat a child at a dining table.

Further objects are to achieve the above with devices that are sturdy, compact, durable, lightweight, simple, safe, efficient, versatile, ecologically compatible, energy conserving, and reliable, yet inexpensive and easy to manufacture, move, and maintain.

Other objects are to achieve the above with a method that is safe, rapid, versatile, ecologically compatible, energy conserving, efficient, and inexpensive, and does not require skilled or psychologically trained people to use and maintain.

The specific nature of the invention, as well as other objects, uses, and advantages thereof, will clearly appear from the following description and from the accompanying drawing, the different views of which are not scale drawings.

Figure 1:
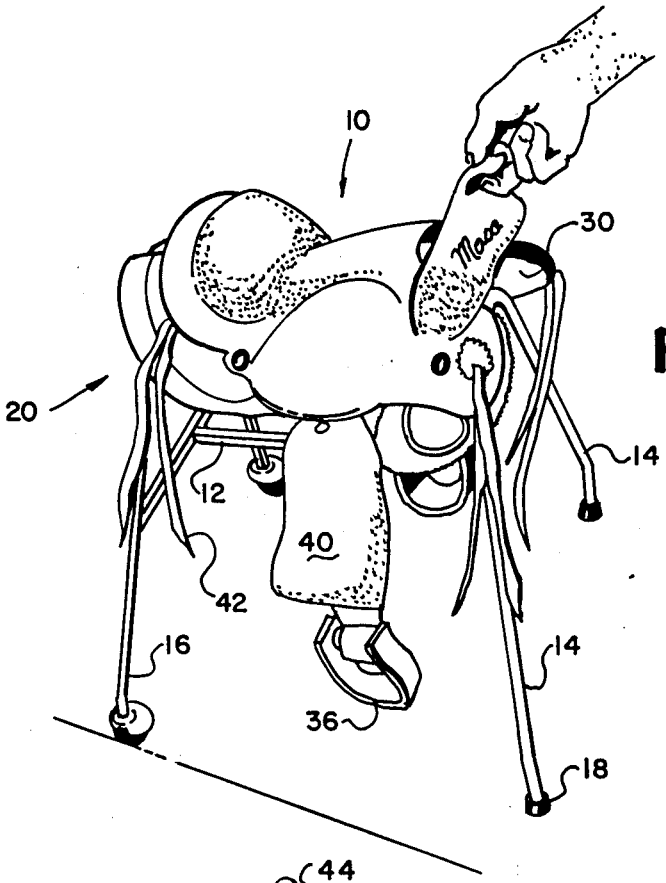
FIG. 1 is a perspective view of an embodiment of this invention with the front portion raised while being rolled on the rear legs.
Figure 2:
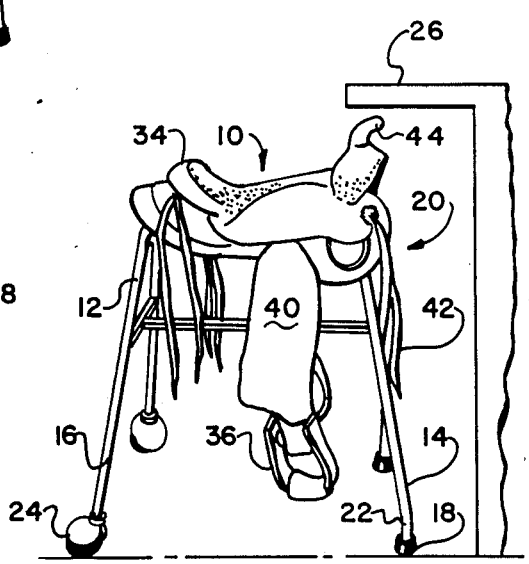
FIG. 2 is a perspective view of the embodiment at a table with the forward portion beneath the table in an eating position.
Figure 3:
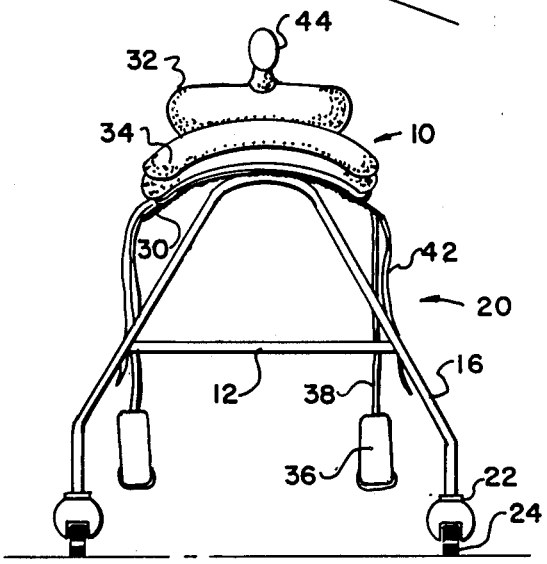
FIG. 3 is a rear elevational view thereof. As an aid to correlating the terms of the claims to the exemplary drawing, the following catalog of elements and steps is provided.

10 replica
12 horse or stand
14 front leg
16 rear legs
18 tips
20 seat
22 feet
24 roller
26 table
30 pad
32 pommel
34 cantle
36 stirrups
38 stirrup straps
40 sudadero
42 saddle strings
44 horn

DESCRIPTION OF THE PREFERRED EMBODIMENT

Referring to the drawings, there may be seen a child's replica 10 of a western saddle (also known as a cowboy saddle, a Texas saddle, or a Mexican saddle). The replica is attached or mounted upon rigid horse 12 having four legs; two front legs 14 and two rear legs 16. The horse, with legs, forms a stand upon which the replica is mounted.

The replica and the stand, together, form the child's seat 20. The horse or stand 12 is shown in the drawing as a rigid structure made of metal tubing. Feet 22 at the bottom of the four legs are spread wide so that the stand has good stability. This is important because with normal active children, it is necessary that there be no danger of the stand being tipped over. The stand is cross braced for rigidity and strength.

The front legs have rubber tips 18 on the bottom thereof. The tips are very similar to crutch tips. Therefore, if there is no lifting of the front of the seat, the tips are anchor means for anchoring the front of the seat securely in position.

Rollers 24 are attached at the feet 22 of the two rear legs 16. Therefore, by lifting at the front of the replica, the front two legs may be easily lifted from the floor and the stand easily rolled to different positions, with or without a child upon the seat.

Therefore, the child can mount the seat and sit upon the replica as soon as he enters the restaurant. He can be easily wheeled to dining table 26 by an adult lifting the front of the seat, thereby lifting the front legs off the floor and rolling it so that the front of the seat is below the top of the dining table and the child is close to the dining table so that food can be placed thereon for the child.

The preferred form of the replica 10 is a child's replica of a western saddle, as illustrated in the drawings. It is preferred that the replica be as authentic as possible. It is preferred that the replica be covered with embossed leather and fitted with sheepskin pad 30. Also, it is desirable that it have the usual parts of a saddle; namely, pommel 32, cantle 34, stirrups 36, stirrup straps 38, sudadero 40, saddle strings 42, and horn 44.

The horn provides a convenient handle to grasp the front of the seat 20 when moving it from one location to another.

It is important that the replica be authentic. Children, and certain older children can recognize the difference between the authentic leather, sheepskin, etc. and plastic. If it is authentic, the older children do not scorn it as "baby".

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A child's seat for eating at a dining table comprising:

a replica of a childhood fantasy with a front, said replica mounted on a rigid stand having four legs, with two legs in front and two legs in rear, swivel rollers on the two rear legs so that the front of the seat may be lifted and moved, said seat is at the table with the front of the replica under the table, and anchor means on the front two legs for anchoring the seat with a child thereon.

2. The invention as defined in claim 1 wherein said replica is a child size replica of a western saddle with a horn at the front.

3. The invention as defined in claim 1 wherein said anchoring means is in the form of rubber tips.

4. A child's seat for eating at a dining table comprising:

a child size replica of a western saddle covered with embossed leather, fitted with a sheep skin pad and having a pommel, cantle, stirrups, stirrup straps, sudadero, and saddle strings, with a horn at the front of the saddle, a rigid stand having four legs, with two legs in front and two legs in rear, said saddle attached to the rigid stand, swivel rollers on the two rear legs so that the front of the seat may be lifted by the horn and moved to a position with the front of the saddle, including the horn under the table, and rubber tips forming anchors on the front two legs for anchoring the seat with a child thereon.

* * * * *